US006370747B1

(12) United States Patent
Lewin et al.

(10) Patent No.: US 6,370,747 B1
(45) Date of Patent: Apr. 16, 2002

(54) METHOD AND APPARATUS FOR THE BULK COLLECTION OF TEXTURIZED STRAND

(75) Inventors: David Frederick Lewin, Granger, IN (US); Michael Blaise Fazio, Newark, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 30 days.

(21) Appl. No.: 09/661,329

(22) Filed: Sep. 13, 2000

(51) Int. Cl.[7] ..... D02G 1/16; B65H 54/76
(52) U.S. Cl. ..... 28/289; 28/271; 65/438
(58) Field of Search ..... 28/289, 290, 291, 28/247, 271, 273, 274; 19/304, 299; 226/97.2, 97.4, 97.1, 7; 65/438, 475, 476, 478, 504, 505, 524; 242/362, 360

(56) References Cited

U.S. PATENT DOCUMENTS

| | | | | |
|---|---|---|---|---|
| 2,415,075 A | | 2/1947 | Abbott | |
| 2,741,009 A | | 4/1956 | Slayter et al. | |
| 3,281,913 A | * | 11/1966 | Morehead et al. | 28/255 |
| 3,509,687 A | * | 5/1970 | Fierssner | 28/289 |
| 3,849,847 A | * | 11/1974 | Corbiere | 264/103 |
| 3,912,479 A | | 10/1975 | Roberson | |
| 3,951,321 A | * | 4/1976 | Heusser | 226/108 |
| 3,956,807 A | * | 5/1976 | Holland | 28/237 |
| 3,968,877 A | * | 7/1976 | Mattis | 19/66 T |
| 4,033,741 A | | 7/1977 | Drummond | |
| 4,069,566 A | | 1/1978 | Sumitomo et al. | |
| 4,098,444 A | * | 7/1978 | Cole | 226/97.4 |
| 4,185,064 A | * | 1/1980 | Schippers | 264/103 |
| 4,217,159 A | * | 8/1980 | Ellis et al. | 156/177 |
| 4,285,452 A | * | 8/1981 | Reba et al. | 19/299 |
| 4,422,225 A | * | 12/1983 | Kurzke | 28/289 |
| 4,543,690 A | * | 10/1985 | Potters | 19/300 |
| 4,554,716 A | * | 11/1985 | Nunn | 28/263 |
| 4,569,471 A | | 2/1986 | Ingemansson et al. | |
| 4,817,880 A | * | 4/1989 | Lenk et al. | 226/108 |
| 5,051,123 A | * | 9/1991 | Nurmi | 156/62.2 |
| 5,368,623 A | | 11/1994 | Hirschmann et al. | |
| 5,688,301 A | * | 11/1997 | Brandon et al. | 19/65 R |
| 5,766,541 A | | 6/1998 | Knutsson et al. | |
| 5,976,453 A | | 11/1999 | Nilsson et al. | |

* cited by examiner

*Primary Examiner*—Amy B. Vanatta
(74) *Attorney, Agent, or Firm*—Inger H. Eckert; Stephen W. Barns

(57) ABSTRACT

A method and apparatus for collecting texturized strand are disclosed. The apparatus for collecting texturized strand includes a texturizer for expanding a continuous strand of glass fibers into a wool-like product, a container for collecting the texturized strand, and a device establishing a pressure differential between an interior region of the container and a region external of the container. The texturizer includes a nozzle to which a supply of compressed air and a continuous strand are fed. The compressed air advances the strand of glass fibers through the nozzle and expands the strand so that the filaments are spread apart, thereby giving the strand a wool-type appearance. The pressure differential creating device includes a vacuum apparatus for drawing air and a screen through which the air flows. A container is placed on the screen. In the preferred embodiment, the container is a corrugated box that has upper and lower closures or flaps. The lower flaps are folded back, thereby revealing an opening in the bottom. The container is coupled to the pressure differential creating device so that the container opening is in communication with the screen. The nozzle is manipulated to direct the strand from the outlet of the nozzle into the container. The system may include a deflector assembly for changing the direction of the texturized strand as it is directed into the container.

14 Claims, 4 Drawing Sheets

METHOD AND APPARATUS FOR THE BULK COLLECTION OF TEXTURIZED STRAND

TECHNICAL FIELD AND INDUSTRIAL APPLICABILITY OF THE INVENTION

This invention relates to the bulk collection of texturized strand, and in particular, to a method and apparatus for the bulk collection of texturized strand. The invention is useful in the production of sound absorbers that may be used to reduce noise emissions of a vehicle.

BACKGROUND OF THE INVENTION

This invention relates to the bulk collection of strand, and in particular, to the bulk collection of texturized strand. A strand of glass filaments is typically formed by attenuating molten glass through a plurality of orifices in a bottom plate of a bushing. The filaments are attenuated by applying tractive forces to the streams of glass, so as to attenuate the streams. The filaments are coated with a size or binder material which serves to provide a lubricating quality to the individual filaments to provide them with abrasion resistance. The glass filaments are sized with the size material substantially immediately after they are formed. The filaments are gathered in parallel relationship to form a strand.

In conventional filament forming systems, the streams of glass have been attenuated by winding the filaments on an exterior of a rotating tube. The strand of filaments is wound on the tube as a cylindrical package. The winding device with the rotating tube pulls the filaments and collects the strand.

Instead of winding the strand around a rotating tube, the strand may be gathered into a container. The strand is typically collected in a container when it is attenuated by a pulling device such as mating wheels or a pair of belts. A bulk collection of strand can be easily shipped and used in subsequent processes.

Texturized strand is continuous strand that has been expanded or texturized. The fibers in the strand are separated to give the strand a full, wool-like appearance. Texturized strand has good acoustic and thermal insulative properties. Texturized strand is typically used in sound absorbers.

Sound absorbers are used to reduce noise emissions and have numerous applications, for example, a muffler for a vehicle. A conventional sound absorber often includes a sound absorbing material, such as fiberglass wool, that is disposed between a housing and an inner tube and that dampens or attenuates noise in the gas flowing through the muffler.

One process for manufacturing a sound absorber with texturized strand is to directly fill the sound absorber with the strand. U.S. Pat. No. 4,569,471 to Ingemansson et al. ("Ingemansson") relates to a process and apparatus for feeding lengths of continuous glass fiber strands into a muffler outer shell such that the fiber strands are expanded into a wool-like material inside the shell. The manufacturing process in Ingemansson requires that expensive apparatus be available at manufacturing locations where muffler shells are filled with sound absorbing material. In addition, some muffler types have intricate shapes and are not easily filled with sound absorbing material such that the sound absorbing material uniformly fills the entire inner cavity of the muffler shell.

A need exists for an inexpensive way to collect texturized strand in a bulk form which permits the subsequent use of the strand. A need also exists for an inexpensive way to collect texturized strand so that it can be pulled from the container in which it is collected.

SUMMARY OF THE INVENTION

The shortcomings of the prior art are overcome by the disclosed method and apparatus for collecting texturized strand. The apparatus for collecting texturized strand includes a texturizer for expanding a continuous strand of glass fibers into a texturized or wool-like product, a container for collecting the texturized strand, and a device establishing a pressure differential between an interior region of the container and a region external of the container.

The texturizer includes a nozzle to which a supply of compressed air and a continuous strand are fed. The compressed air advances the strand of glass fibers through the nozzle and expands the strand so that the filaments are spread apart, thereby giving the strand an expanded shape or form.

The pressure differential establishing device includes a vacuum apparatus for drawing air and a screen through which the air flows. A container is placed on the screen. In the preferred embodiment, the container is a corrugated box that has upper and lower closures or flaps. The lower flaps are folded back, thereby revealing an opening in the bottom. The container is coupled to the pressure differential creating device so that the container opening is in communication with the screen.

The nozzle is manipulated to direct the strand from the outlet of the nozzle into the container. The system may include a deflector assembly for changing the direction of the texturized strand as it is directed into the container.

DETAILED DESCRIPTION AND PREFERRED EMBODIMENTS OF THE INVENTION

A method and apparatus for collecting texturized strand embodying the principles of the invention are illustrated in FIGS. 1–6. The disclosed apparatus improves the collection of texturized strand by collecting the strand in bulk form in such a manner that facilitates the subsequent attenuation of the strand. The disclosed method of collecting a texturized strand improves the strand collection process, particularly by maintaining the texturization of the strand as the strand is collected in a container.

In the conventional bulk collection of a continuous strand, the strand is directed into a container. Typically, the strand is collected in a container in a series of layers that overlap each other. Depending on the desired final product, each layer of strand may be deposited in a particular pattern. Alternatively, the strand may be deposited in a random manner.

In some applications, such as sound absorbers, a continuous strand is expanded into a texturized or wool-like form. The texturized product is typically created by expanding a continuous strand of glass fibers. The strand is expanded by directing compressed air at the strand as it passes through a texturizer to separate the filaments in the strand. This concept is also referred to as "texturizing" the strand.

An example of a device for expanding a strand is disclosed in U.S. Pat. No. 5,976,453 to Nilsson (assigned to Owens-Corning Sweden AB), the disclosure of which is expressly incorporated by reference herein. The device of Nilsson uses compressed air in a nozzle to separate fibers in a fiberglass strand and direct them through a nozzle outlet and into a particular container. As the strand passes through the nozzle, the compressed air in the nozzle imparts a slight twist to the strand. As the strand is discharged from the nozzle outlet, the strand has a gradual coil shape, which is referred to as the texturization of the strand.

A texturized strand may be collected in bulk form for use in a subsequent process. The texturized strand is directed into a container using the texturizing nozzle. However, since the strand has been texturized, fibers of different layers of the strand may entangle and form loops which make the runout of the strand from the container difficult.

In order to reduce the frequency of these loops in the container, the texturization of the strand is maintained. One way to maintain the texturization of the strand is to hold the strand in place as the strand is collected in the container.

With these general principles identified, selected implementations of these principles in currently preferred embodiments are set forth below.

Figure 1:
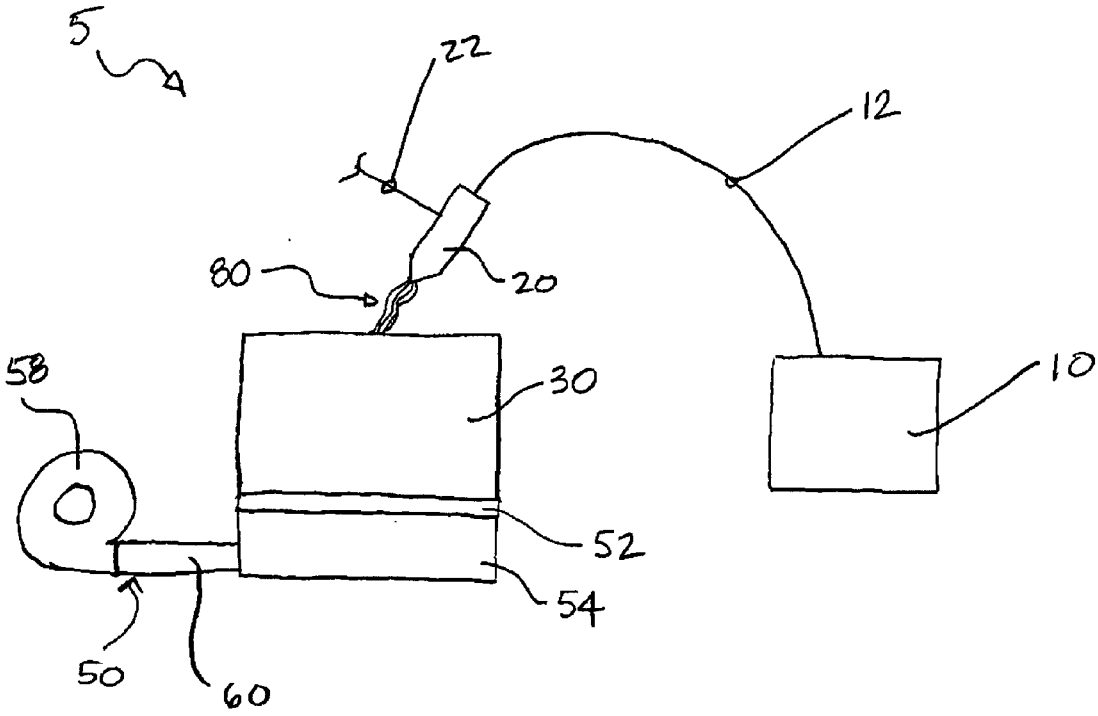
FIG. 1 is a schematic side view of a strand collection system embodying the principles of the invention.

A strand collection method and system embodying the principles of the invention is shown in FIGS. 1–6. As illustrated in FIG. 1, the strand collection system 5 includes a glass supply 10 and a texturizer 20. The texturizer 20 expands a strand 12 from the glass supply 10 into a texturized strand 80.

The collection system 5 includes a container 30 in which the texturized strand 80 is collected. The texturizer 20 is operated so that the texturized strand 80 is evenly collected in the container 30. In the illustrated embodiment, the nozzle 20 is manipulated by an operator.

The texturizer 20 includes a nozzle and a compressed air supply 22 from an air compressor (not shown). The air supply 22 advances the strand 12 through an internal passage in the nozzle. The air supply 22 also separates, entangles, and imparts a twist to the fibers of the strand 12 so that the texturized strand 80 emerges from the outlet of the nozzle 20 as a continuous expanded strand. Air is discharged from the nozzle with the texturized strand 80.

The artisan will appreciate that the air supply 22 is provided to the nozzle 20 during the texturization of a particular length of strand, which is determined by many factors, including the volume of the container. The nozzle includes a cutting apparatus (not shown) that cuts the texturized strand from the glass supply as appreciated by the skilled artisan.

The collection system 5 includes a pressure differential establishing device 50 that is used to establish a low pressure region in the container 30. As illustrated in FIG. 1, the device 50 includes a vacuum-like apparatus 58 and a base 54 with a screen 52 positioned thereon. The interior of the base 54 is preferably hollow and a hose 60 fluidically couples the vacuum apparatus 58 and the base 54.

Figure 2:
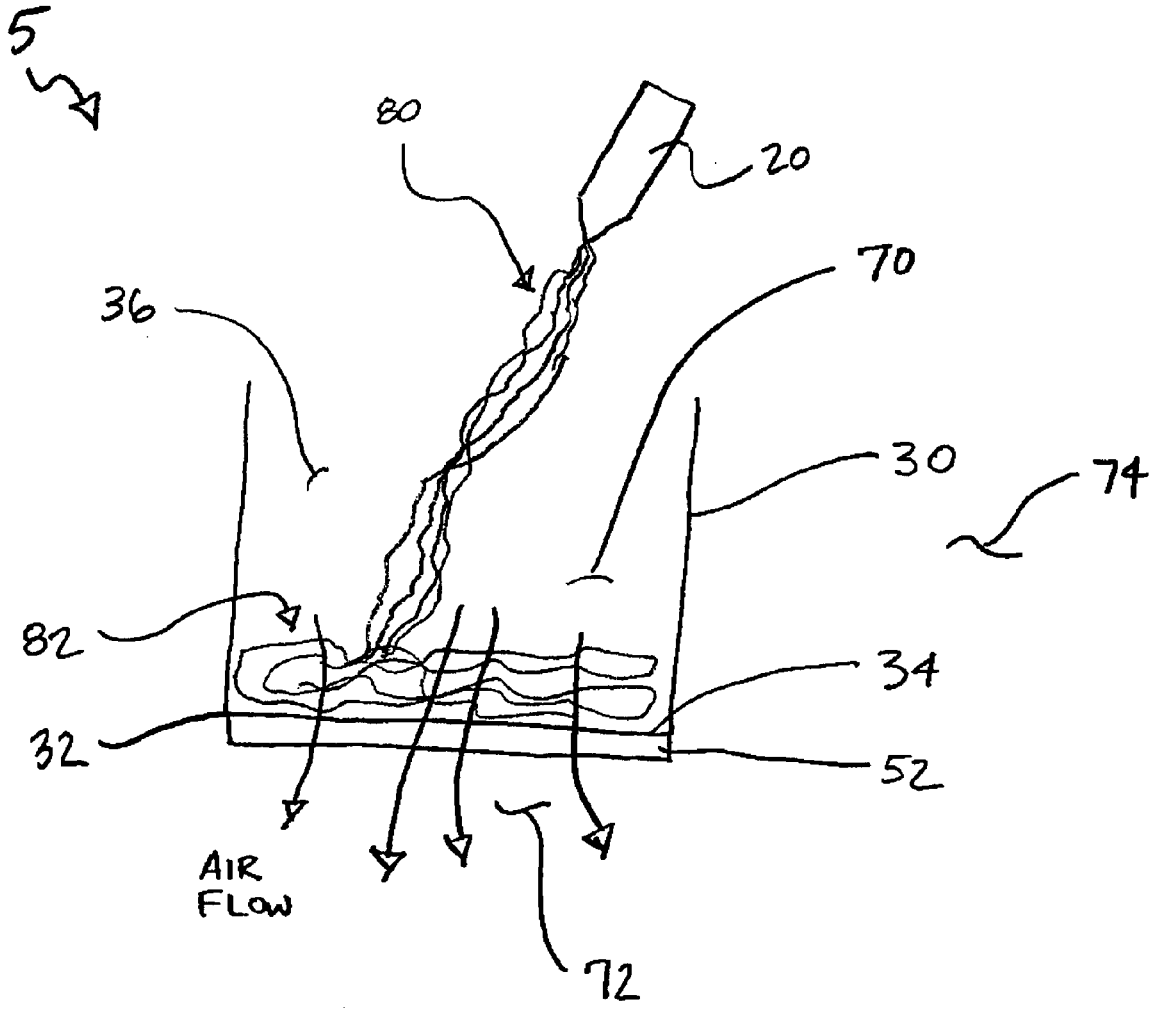
FIG. 2 is a cross-sectional view illustrating a strand collection process embodying the principles of the invention.

The relationship of the device 50 and the container 30 is illustrated in FIG. 2. The container 30 includes an interior region 36 and a bottom surface 32 that has an opening 34, as described in greater detail below. During the strand collection operation, the texturized strand 80 is directed into the container 30 to form a mass 82 of strand 80.

The pressure differential creating device 50 draws air from the interior region 36, through the screen 52, and into a region external of the container 30 along the direction of the arrows illustrated in FIG. 2. The device 50 establishes an interior low pressure region 70 in the container 30 and an external low pressure region 72. Preferably, the air pressure in each of the low pressure regions 70, 72 is less than the ambient 74 air pressure.

In the illustrated embodiment, the external low pressure region 72 is at a lower pressure than the interior low pressure region 70. As a result, air flows through the screen 52 from region 70 into region 72. The air flow and the pressure differential between the interior region 70 and the external region 72 maintain the collected mass 82 of strand 80 in the position in which it is collected. Accordingly, the texturized strand 80 maintains its texturized form since it is held in its collected position.

As the artisan will appreciate, since the depth of the mass 82 of strand 80 influences the air flow from region 70 to region 72, the texturized strand 80 is preferably collected at an even level in the container 30. An uneven collection of strand 80 results in an uneven air flow and the potential for some of the strand to lose its texturization.

In the illustrated embodiment, the operator orients the nozzle so that the strand is directed toward the area of the least mass in the container 30 to fill the container 30 evenly.

Figure 3:
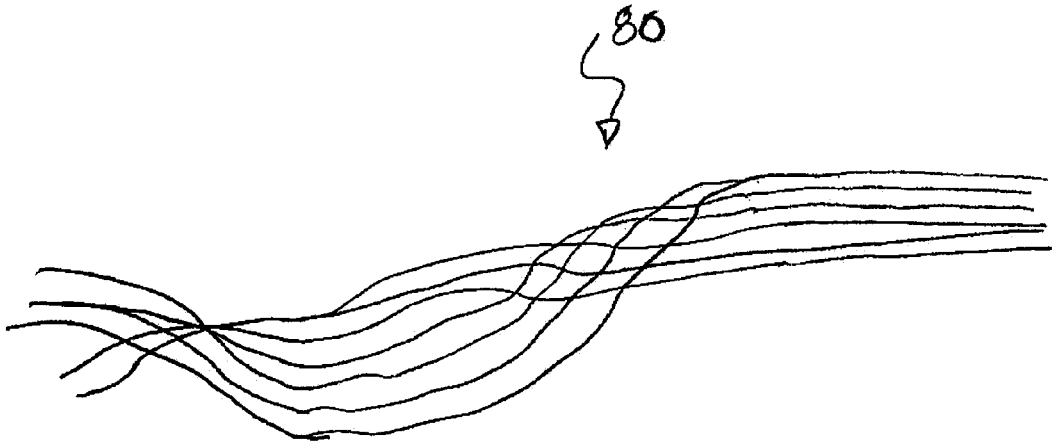
FIG. 3 is a schematic view of a texturized strand embodying the principles of the invention.

An example of a texturized strand embodying the principles of the invention is illustrated in FIG. 3. The texturized strand 80 has a coiled shape that is imparted on the strand by the nozzle 20. The frequency and length of the coils in the strand 80 are determined by the flow and pressure of the compressed air in the nozzle 20. If the air flow or pressure of the air in the nozzle increases, then the amount of twist imparted on the strand increases as well. As the artisan will appreciate, an increase in the twist results in an increase in the coils in the strand 80.

Figure 4:
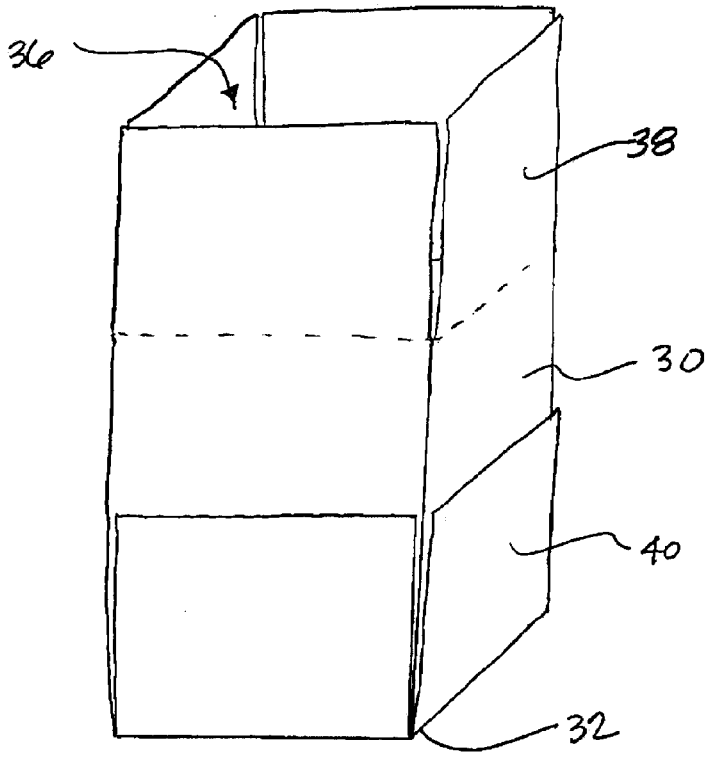
FIG. 4 is a perspective view of a container embodying the principles of the invention.

An example of a container embodying the principles of the invention is illustrated in FIG. 4. The container 30 includes side walls defining an interior region 36. The container 30 includes an upper closure or flaps 38 and a lower closure or flaps 40 that are coupled to the top and bottom surfaces of the side walls, respectively. During the strand collection process, the lower flaps 40 are folded upwardly to provide an opening 34 in the bottom surface 32 of the container 30.

Figure 5:
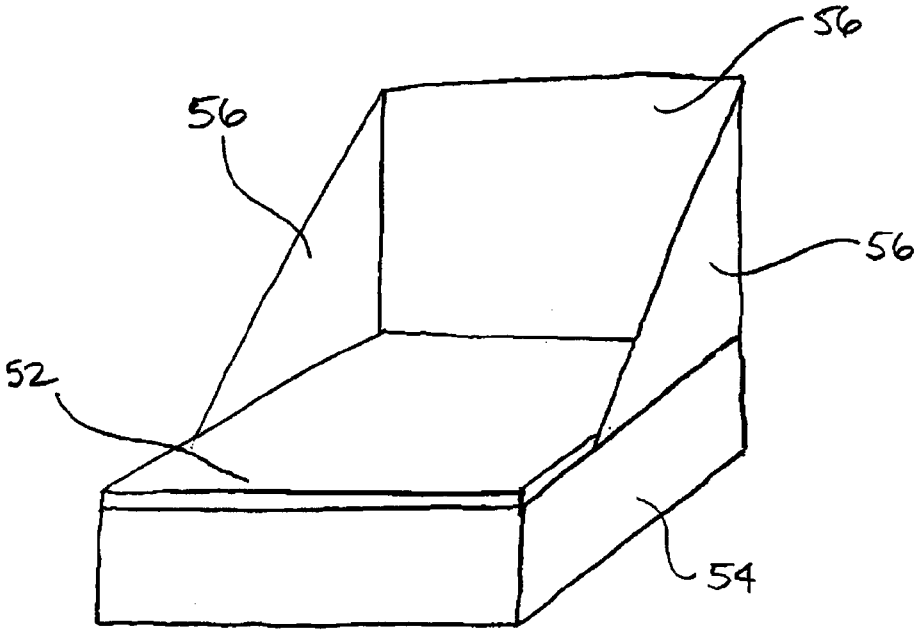
FIG. 5 is a perspective view of a base of a pressure differential creating device embodying the principles of the invention.

An exemplary embodiment of the base of the pressure differential establishing device is illustrated in FIG. 5. The device 50 includes a screen 52 that is positioned on base 54. The device 50 includes side walls 56 coupled to the base 54 to provide support for the container 30 when it is positioned on the screen 52. The base 54 includes a hollow interior chamber with a port (not shown) that is in fluidic communication with the device 50 as discussed above.

Figure 6:
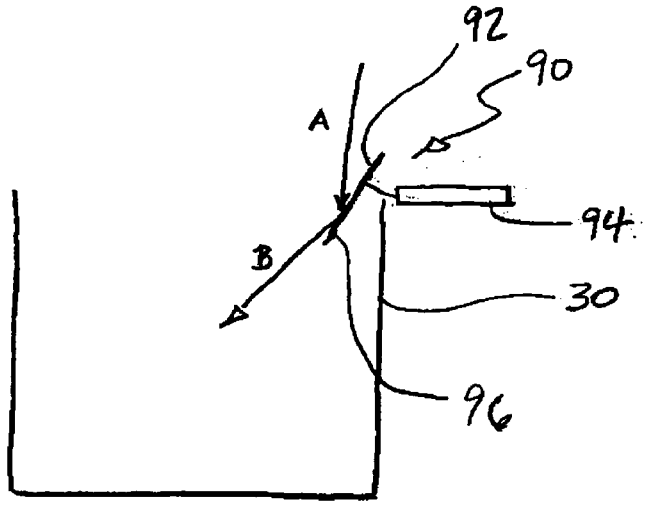
FIG. 6 is a cross-sectional schematic view illustrating an alternative strand collection process embodying the principles of the invention.

An alternative embodiment of a strand collection system embodying the principles of the invention is illustrated in FIG. 6. In this embodiment, the strand collection system 5 includes a deflector assembly. The deflector assembly 90 changes the direction of the strand as it is directed into the container 30.

The deflector assembly 90 includes a plate 96 with a deflector surface 92 and a support 94. The plate 96 is mounted at an angle with respect to a horizontal plane as shown in FIG. 6.

The support 94 may be coupled to a support structure (not shown). The support structure may be moved relative to the container 30. For example, the support structure may be moved transversely across the container 30. Alternatively, the support 94 may be fixed relative to the container.

As the texturized strand 80 is discharged from the nozzle 20, its velocity is generally in a particular direction. The direction that the strand 80 enters the container 30 can be varied by moving the nozzle 20 with respect to the container 30. As the artisan will appreciate, the nozzle 20 typically will be mounted above the deflector assembly 90 so that the texturized strand 80 is continuously deflected into the container 30. Also, the velocity direction of the strand 80 changes after it contacts surface 92.

In FIG. 6, the texturized strand 80 is initially discharged from the nozzle 20 along the direction of arrow "A." As the strand 80 impacts the plate 96, it travels along the direction of arrow "B."

Now the operation of the strand collection system is described. Initially, a container 30 is prepared for collecting strand. The upper flaps 38 are opened and the lower flaps 40 are opened and folded upwardly. Hose 60 is coupled to the vacuum apparatus 58 and base 54. The screen 52 is positioned on the upper surface of the base 54.

The container 30 is positioned on the screen 52 so that the container opening 34 is aligned with the screen 52. A strap (not shown), such as an elastic cord, is wrapped around the lower flaps 40 of the container 30 and the side walls 56 to retain the container on the base 54.

An end of a continuous strand 12 is thread through nozzle 20. The end is coupled to an upper inside surface of the container 30 with tape. The strand 12 is positioned along the inside surface of the container 30.

The device 50 is turned on and compressed air is supplied to the nozzle 20. The air supply 22 directs the strand 12 through the nozzle 20 and expands the strand 12. The strand is discharged from the nozzle 20 as a texturized strand 80.

The operator holding the nozzle 20 directs the texturized strand 80 into the container 30. Preferably, the operator moves the nozzle 20 around so that the container 30 is filled evenly with the strand 80. As the strand 80 is collected, a mass 82 of strand is collected on the screen 52.

The texturization of the strand continues until the container 30 is close to being full. Preferably, the container 30 is not filled completely to accommodate the expansion of the collected strand 80 when the device 50 is turned off. The strand 12 is cut in the nozzle 20.

The trailing end of the strand 12 is pulled from the nozzle 20 and coupled to the container 30 close to the leading end of the strand 12. The end user of the texturized strand 80 is able to locate both ends of the strand in the container 30.

The screen 52 is coupled to the container 30 to temporarily seal the bottom 32 of the container 30. An upper closure is placed on the top of the container 30. In the illustrated embodiment, the operator closes the flaps 38 and seals the top of the container 30.

The operator flips the container 30 over so that the bottom surface 32 of the container 30 is up. The screen 52 is removed and a lower closure is placed on the bottom of the container 30. In this embodiment, the operator closes the flaps 40 and seals the bottom of the container 30. Finally, the container 30 is flipped over so that it is in its initial position. The container 30 is then shipped to a customer for use in a subsequent process.

Preferably, the container is a corrugated, paper box. The screen is preferably metal, such as steel. The base of the suction device may be any material that can support the container, including wood and metal. The screen is a conventional screen that is made from metal, such as aluminum. The components of the deflector assembly are preferably made from metal.

The strand is preferably a glass fiber with a relatively high resistance to thermal degradation. Suitable glass fibers include A glass, Standard E glass, S glass, T glass, ECR glass, Advantex® (Calcium-Aluminum-Silicate glass), ZenTron™ glass, or any other composition with suitable strength to withstand the texturization process.

The following ranges of dimensions are provided for an exemplary texturized strand embodying the principles of the invention:

density of texturized strand in container=5 to 10 lbs/ft$^3$ (80 to 160 kg/m$^3$)

length of a coil in texturized strand=0.25 to 24 in. (0.5 to 61 cm)

frequency of coils=10 per in. (4 per cm)

The artisan will appreciate that there are many possible variations on the particular embodiment described above that would be consistent with the principles of the invention.

For example, the movement of the nozzle may be automatically controlled. The nozzle can be mounted on a mechanism that reciprocates above the container to ensure the even distribution of the strand. In addition, the nozzle may be mounted to the deflector assembly.

The container is not limited to a four sided, corrugated, paper box. The container may be any suitable material that can retain the texturized fiberglass. In addition, the container may be circular or have more or less than four sides.

The closure devices on the container may be structures other than flaps. For example, the closure devices may be lids that are placed on the top and bottom of the container and subsequently coupled thereto.

The deflector assembly may be moveable relative to the container. Alternatively, the deflector assembly may be fixed relative to the container. The deflector assembly may include a circular housing around the deflector plate. The deflector assembly may travel across the width of the container and oscillate as it travels.

The strand collection system may include a sensor to sense the level of texturized strand in the container during the collection process.

The strand collection system may automatically fill the container, eliminating the need for an operator. In this system, the amount of strand in the container may be determined based on the filling time or the quantity of strand that has been taken from the glass supply.

The low pressure region in the interior of the container may be establishing by a mechanism other than a vacuum. For example, a fan may be used to draw air from the interior region.

We claim:

1. A method of collecting a strand, the method comprising the steps of:

texturizing the strand;

directing the texturized strand into a container having an interior region to form a mass of collected strand; and establishing a pressure differential between the interior region of the container and a region external of the container, wherein the pressure differential maintains the strand in a texturized form.

2. The method of claim 1, wherein said step of texturizing the strand includes feeding compressed air and the strand into a nozzle and expanding the strand with the nozzle.

3. The method of claim 1, wherein said step of texturizing the strand includes twisting the strand into a coiled shape.

4. The method of claim 3, wherein said strand has the coiled shape substantially along its length when the strand is in the container.

5. The method of claim 3, wherein said step of establishing a pressure differential includes maintaining the coiled shape of the strand after the strand has been collected in the container.

6. The method of claim 2, wherein said step of texturizing includes texturizing the strand with the nozzle and said step of directing the texturized strand includes directing the texturized strand into the container with the nozzle.

7. The method of claim 1, wherein said step of texturizing the strand includes imparting to the strand a velocity in a first direction and said step of directing the texturized strand includes deflecting the strand off a first surface disposed at an angle to said first direction to change the direction of travel of the strand as it is directed into the container.

8. The method of claim 1, wherein said step of establishing a pressure differential includes fluidically coupling the interior region of the container and the external region so that an air flow is created between the interior region and the external region.

9. A system for texturizing a strand comprising:

a container for collecting the strand, the container having an interior region;

means for establishing a pressure differential between said interior region and a region external of said container; and a texturizer for texturizing the strand and directing the strand into said container, wherein the strand is maintained in a texturized form by the pressure differential as it is collected in said container.

10. The system of claim 9, wherein said means for establishing a pressure differential includes a screen through which air flows to establish an air flow between said interior region and the external region.

11. The system of claim 10, wherein said container includes a bottom surface having an opening, and said container is placed on said screen so that said opening fluidically couples said interior region and the external region.

12. The system of claim 9, wherein said texturizer is a nozzle and compressed air and strand are supplied to said nozzle which utilizes the compressed air to expand the strand into its texturized form.

13. The system of claim 12, wherein said nozzle expands said strand into a coiled shape.

14. The system of claim 13, wherein said strand has the coiled shape substantially along its length and said pressure differential maintains the strand in its coiled shape after the strand has been collected in said container.

* * * * *